United States Patent [19]

Roller

[11] Patent Number: 4,723,722

[45] Date of Patent: Feb. 9, 1988

[54] DEVICE FOR TRANSFERRING BOBBINS TO A SPOOLING FRAME

[75] Inventor: Siegfried Roller, Fellbach, Fed. Rep. of Germany

[73] Assignee: C. Eugen Maier Metallverarbeitung GmbH, Fed. Rep. of Germany

[21] Appl. No.: 900,729

[22] Filed: Aug. 27, 1986

[30] Foreign Application Priority Data

Aug. 31, 1985 [DE] Fed. Rep. of Germany ..... 3531184

[51] Int. Cl.[4] ..... B65H 67/06

[52] U.S. Cl. ..... 242/35.5 A; 198/424; 198/433

[58] Field of Search ..... 242/35.5 A, 35.5 R, 242/35.6 R; 198/424, 433, 451; 221/89, 90, 91, 174

[56] References Cited

U.S. PATENT DOCUMENTS

| | | | |
|---|---|---|---|
| 3,224,694 | 12/1965 | Oishi | 242/35.5 A X |
| 3,279,710 | 10/1966 | Raasch | 242/35.5 R |
| 3,389,866 | 6/1968 | Mullers | 242/35.5 R |
| 3,480,216 | 11/1969 | Iannucci et al. | 242/35.5 R X |
| 3,506,209 | 4/1970 | Matsui et al. | 242/35.5 A X |
| 3,774,859 | 11/1973 | Brouwer et al. | 242/35.5 A X |
| 3,933,320 | 1/1976 | Tsurumi et al. | 242/35.5 R |
| 3,966,141 | 6/1976 | Nishiyama et al. | 242/35.5 A |
| 4,212,433 | 7/1980 | Matsui et al. | 242/35.5 A |
| 4,272,034 | 6/1981 | Dimitrov | 242/35.5 A X |
| 4,558,829 | 12/1985 | Aretz et al. | 242/35.5 A |

*Primary Examiner*—Stanley N. Gilreath
*Attorney, Agent, or Firm*—McGlew and Tuttle

[57] ABSTRACT

A device for transferring bobbins of yarn from a bobbin container to a bobbin receptacle on a spooling frame where the yarn is "refined" by cutting out bad spots, has slide gate units (13, 14) that are divided into slide gate unit halves. On the basis of a control system that comprises in particular an optical monitoring device (40, 41, and 42, 43), a given row of bobbins are transferred by a box slide from the bobbin container to the slide gate units (13, 14) or sliding gate unit halves. In two steps they fall from there onto a pair of cross-conveyors (11, 12) that operate in opposite directions. Each cross-conveyor is associated with a righting chute (10). A bobbin that is on the outside by-passes the cross-conveyor and falls directly onto the righting chute, while the others are transferred, at intervals, to the righting chute, as it is emptied. With the aid of a controllable supporting end (59) at the lower end of the chute, the bobbin is transferred at the scheduled time, to the bobbin receptacle (6) of one of a number of bobbin holders (4) on the spooling frame (5).

32 Claims, 4 Drawing Figures

DEVICE FOR TRANSFERRING BOBBINS TO A SPOOLING FRAME

FIELD AND BACKGROUND OF THE INVENTION

The present invention relates in general to the field of thread winding equipment, in particular, to a new and useful device for transferring cops or bobbins of yarn or the like from a bobbin container to a bobbin receptacle on a spooling frame.

Spooling frames have a whole series of bobbin holders positioned next to one another holding preferably a plurality, e.g. five or six, of bobbin receptacles. Into these receptacles the bobbins or cops of yarn to be unwound are inserted in the spooling frame. One after the other the bobbins are then unwound, and in the process bad spots are removed from their yarn or the like, and after the associated "refinement" the yarn is rewound into a new bobbin, particularly a crosswound bobbin. The processes are accomplished relatively quickly, for which reason it is a matter of concern that a number and particularly the maximum possible number of bobbins should be standing ready at all times in each bobbin holder. The insertion of the bobbins in the bobbin receptacles is a relatively time-consuming task, particularly if the bobbins are inserted by hand.

SUMMARY OF THE INVENTION

The object of the invention, therefore, is to create a device of the abovementioned kind by means of which all bobbin receptacles of the spooling frame can be automatically loaded, so that after one bobbin is emptied, the process can continue with the next bobbin with the least possible loss of time.

Accordingly, another object of the invention is to provide a device for transferring bobbins of yarn from a bobbin container to a bobbin receptacle on a spooling frame, comprising a device frame, at least two slide gate units lying opposite one another at a distance equal to the length of a bobbin, each for supporting one end of bobbins in a row of bobbins, a cross conveyor connected for movement to the device frame under the slide gate units, a righting chute at a discharge end of said cross conveyor, said righting chute being connected to the device frame and being positioned under the slide gate units, the righting chute having a closeable delivery end which is positionable in front of a receptacle for bobbins in the spooling frame.

The bobbin container holds a large number of bobbins, one hundred, for example. With the aid of a box slide associated with the lower end of the bobbin container, a given number of bobbins in the form of a row or layer of bobbins are transferred, after the corresponding actuation of the box slide, to the two slide gate units, each of which supports one end of all the bobbins in that row of bobbins. The bobbins lie in the bobbin box preferably already sorted so that in the case of conical bobbin cores all the thicker ends of the bobbin cores are oriented toward one slide gate unit, while all the thinner ends are oriented toward the other. At least one cross-conveyor is located in operating position underneath the slide gate units.

Whereas the cops or the like are moved from above to below, in other words, more or less in a vertical direction, when being transferred from the bobbin container or box to the slide gate units and from them onto the cross-conveyor or conveyors, each of the cross-conveyors transports them in a horizontal direction to the righting chute or the like that is located at its delivery end. They fall, preferably by their own weight, from the cross-conveyor onto the righting chute, which has a longitudinal axis that is inclined with respect to the plane of the cross-conveyor. For this reason, the transfer to the righting chute is accompanied by a certain righting or erection of the cop passing down the chute. Since, however, the righting chute is on an angle with the horizontal that does deviate substantially from 90°, the cops passing down the chute do not assume a vertical but rather an inclined position. Since the delivery end of the righting chute can be closed, the cop that reached the bottom of the chute cannot leave it until its delivery end is released. This does not happen until the the delivery end is positioned over a bobbin receptacle of the spooling machine and that bobbin receptacle is empty. All movements are meaningfully coordinated with one another, to insure, for example, that another cop does not fall into the righting chute until it has first been unloaded. Similarly, the slide gate units must be completely emptied before a new row of bobbins can be transferred from the bobbin container.

A further object of the invention is to provide a device for transferring bobbins of yarn from a bobbin container to a bobbin receptacle of a spooling frame which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which preferred embodiment of the invention is illustrated.

BRIEF DESCRIPTION OF THE DRAWINGS

The drawings depict one embodiment of the invention by way of example. In the drawings.

DESCRIPTION OF THE PREFERRED EMBODIMENT

Figure 1:
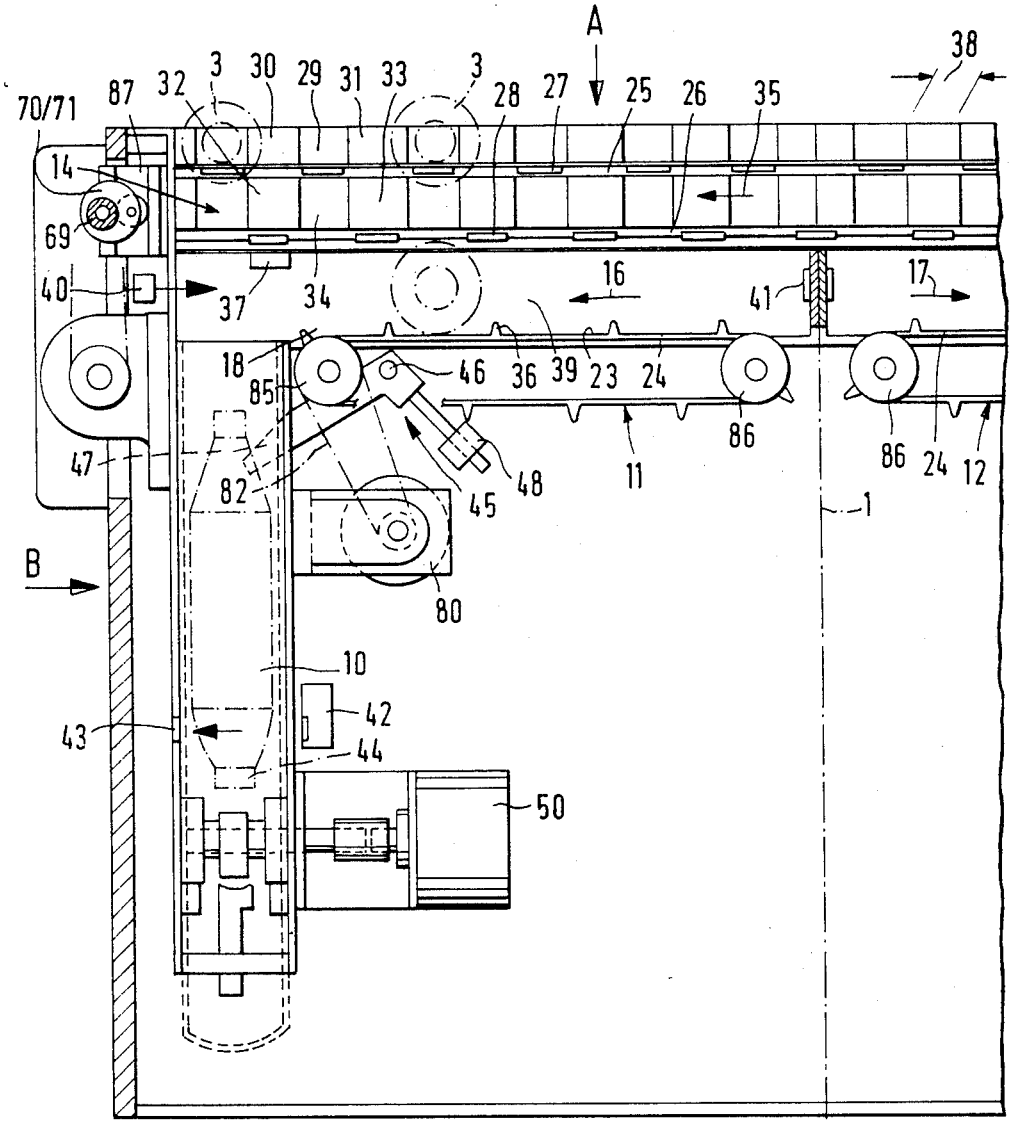
FIG. 1 is a truncated front view of the inventive device.
Figure 2:
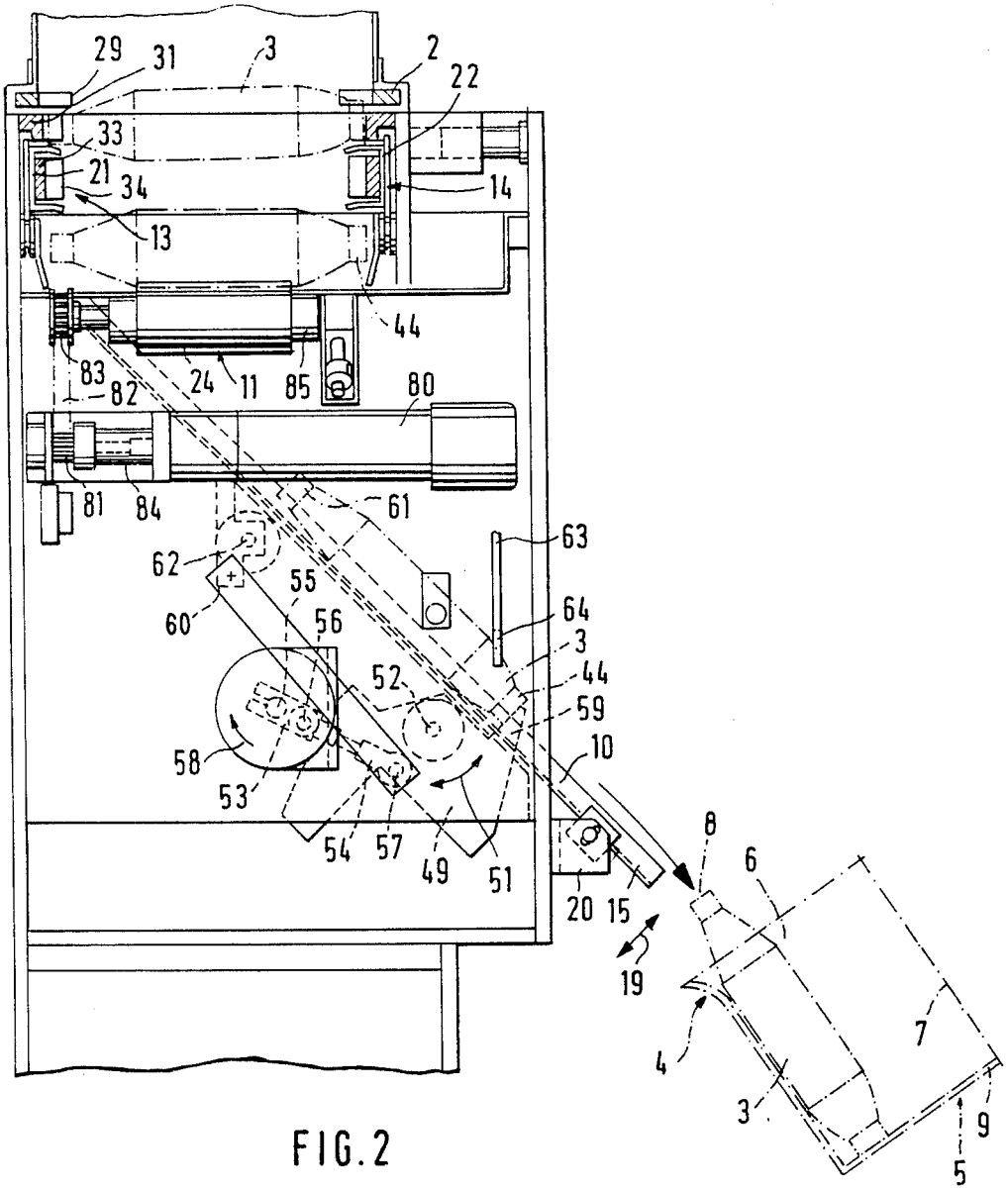
FIG. 2 is a side view of the device taken in the direction of arrow B in FIG. 1.
Figure 4:
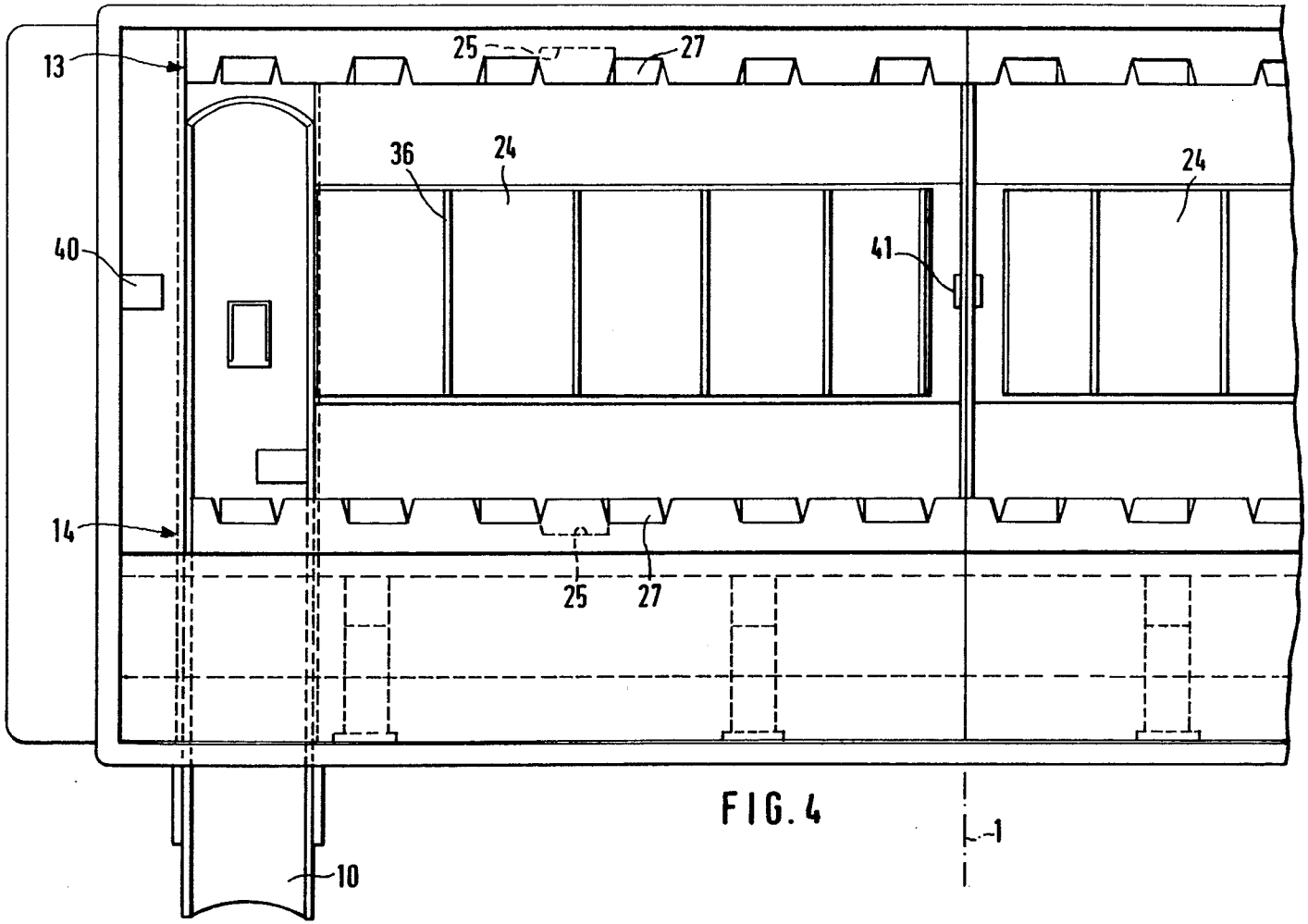
FIG. 4 is a truncated top view of the slide gate unit.

The device in the embodiment used as an example is symmetrically constructed around the vertical plane 1 (FIGS. 1 and 4). In a bobbin container 2 suggested in FIG. 2 are a rather large number of bobbins of yarn or the like of the kind known as cops 3. By means of this device they are to be transferred to the bobbin holder 4, of a spooling frame 5, the spooling frame 5 possessing a whole row of such bobbin holders with a plurality of bobbin receptacles 6, in particular arranged in a circle. When a bobbin is transferred to one of these bobbin receptacles 6, the bobbin holder, which is preferably rotatable, is turned further on its axis 7 until the next bobbin receptacle moves up into place. If, in the case of a conical bobbin core 8, for example, the thicker end of the core should be on the bottom 9 of the bobbin holder 4, the bobbins must already be so oriented in the bobbin container 2. The device is equipped with wheels, sliding blocks or the like, not depicted in detail, with which it can be moved along the spooling frame perpendicular to the projection plane of FIG. 2. An appropriate device makes sure that it is oriented in precisely predetermined position to each bobbin holder on the frame.

When a box slide (not shown) is opened, a given number of cops 3 fall out of the bobbin container 2 onto the tops of slide gate units 13 and 14. When these slide gate units, which are mounted for movement on a frame, are actuated in a manner described below in greater detail, the cops or bobbins drop onto at least one, but in the present embodiment two cross-conveyors 11, 12 positioned lengthwise one after the other, conveying in the directions indicated by the arrows 16 and 17. At the delivery end 18 of each cross-conveyor is a righting chute 10, in the present emobdiment at an angle of roughly 45° to the horizontal. Its delivery end 15 is correlated with a bobbin holder 4 and a bobbin receptacle 6, as shown in FIG. 2. For this purpose, the delivery end can be adjusted, at least in the direction indicated by the double arrow 19, by means of a retaining and adjustive device 20. Each slide gate unit 13, 14 has a slide 21, 22, which is roughly U-shaped in cross-section and that extends parallel to the carrying surface 23 of the conveying elements 24 of the cross-conveyors 11, 12. The two legs of the U run roughly parallel to the carrying surface 23, as can be readily seen in FIG. 2 of the drawings in particular, and the open ends of the legs of the two slides 21 and 22 point toward one another. The upper legs of the U's of slides 21 and 22 are provided with recesses 25, the lower legs with recesses 26, so that upper carrying tabs 27 and lower carrying tabs 28 positioned next to one another at regular intervals are created (FIGS. 1 and 4).

The recesses are so devised, however, that the lower carrying tabs are correlated with gaps or recesses above and vice versa (FIG. 1). When the slide tate units are in starting position the upper carrying tabs 27 are located in each case under guides 29, formed in each case by a pair of blocks 30, 31. Other pairs of blocks 32, 33 create lower guides 34. The lower carrying tabs 28, because of the staggered arrangement vis-a-vis the upper carrying tabs 27, are situated underneath their blocks 32 and 33.

When the cops are transferred from the bobbin container 2 to the slide gate units 13 and 14, due to the design of the box slide (not shown) this comes about in such a way that one end of a cop 3 rests on each of the upper carrying tabs 27, each end lying between neighboring blocks 30 and 31. The vertical distance between the planes defined by the upper carrying tabs 27 on the one hand and the lower carrying tabs 28 on the other hand is approximately equal to or a little larger than the diameter of the ends of the bobbin or the thicker end of the bobbin. Now if the slides 21 and 22 are moved, in the direction indicated by the arrow 35, for example, and in synchrony, the upper carrying tabs 27 open the lower ends of the guides 29, so that the cops 3 lying on them can fall down. Meanwhile, however, the lower carrying tabs 28 are also moved to the lower end of their guides 34, so that the cops are now each held between blocks 32 and 33 and on tabs 28. Not until the slides 21 and 22 are synchronously moved back in the counter-direction to arrow 35 are the lower ends of the guides 34 opened so that the cops can fall down once again. With the exception of the outer left cop shown in FIG. 1 and the outer right cop (not shown) all the others fall onto the corresponding carrying surface 23 of the conveying elements 24 of the two cross-conveyors 11 and 12. The conveying elements 24 have crossridges 36 or the like projecting, outwardly distributed along the circumference, particularly at regular intervals. Between any two such crossridges falls a cop. This means that the conveyor elements 24 must be in a precisely predetermined resting position when the slides 21 and 22 are activated. A symbolically depicted molding 37 or the like separates the empty space above the conveying element 24 from the space above the righting chute 10. The cop that is on the outer edge in each case can fall directly onto the righting chute past the delivery end 18 of the cross-conveyor 11 or 12. Not until this cop has been delivered to a bobbin receptacle 6 will the corresponding cross-conveyor 11 or 12 be driven forward by one segment in the direction of arrow 16 so that the next cop can fall onto the righting chute.

As mentioned earlier, the device is designed as a double device which is symmetrical around the vertical plane 1. For this reason in the embodiment used as an example the slide gate units 13 and 14 are divided into two half slide gate units lying to the left and right of the vertical plane 1. As a result, each slide gate half or each pair of slide gate halves can be operated on its own, so that the cops in the left slide gate half-units can be transferred to their cross-conveyor 11 independently of those in the right slide gate half-units, and vice versa. The particular point of this construction lies in the fact that this device, as mentioned earlier, travels along the spooling frame first, for example, from the left end of the frame to the right and then travels back again from right to left. In one "travelling direction," cops are conveyed down the left righting chute 10, for example, and in the other direction down the right righting chute (not shown). This makes possible an ingenious and comparatively simple positioning of the device with respect to the various bobbin receptacles 6, regardless of the direction of travel. Furthermore, it opens up the possibility of feeding the spooling frame with one kind of cop via one cross-conveyor 11 and another, different kind of cop via the second cross-conveyor 12. The types of cops may differ in their length and diameter and in the yarn. For this reason, it is particularly helpful to enable the blocks 30 through 33 to change in width 38 in a manner not shown in detail, resulting, of course, in a widening or narrowing of the guides 29 and 34.

The intermediate space 39 between each cross-conveyor 11 or 12 and the halves of the slide gate units 13 and 14 above it can be monitored by means of a corresponding monitoring device 40, 41, particularly an optical device consisting of a light source and a reflector. A second monitoring device 42, 43, again particularly an optical device, serves to monitor the righting chute 10. These monitoring devices check for the presence of cops. If none of the monitoring devices detects a cop, the drive for the corresponding pair of slides 21, 22 or slide halves is released or activated. Furthermore, the two slides or slide halves of the two slide gate units 13, 14 or slide gate unit halves are coupled in terms of movement or are synchronously drivable.

Within the field of motion of the cop 3 leaving the delivery end 18 of the cross-conveyor 11 or 12 and falling onto the righting chute 10, or to speak more precisely, within the field of motion of the front end 44 of the cop as it falls down the chute, is a damping lever 45 (FIG. 1). It is a double-armed lever, preferably with an angular shape, that is tiltable about an axis 46. Its free end extending over the chute constitutes an impact member 47, and on its other arm, the right arm of the lever in FIG. 1, is an adjusting weight 48 that can be moved along the length of the arm. The center-of-gravity lever can be adjusted to different cop weights by, for example, screwing the weight up or down on its threaded rod that is fixed to lever 45. The impact member 47 brakes the cop end 44 somewhat so that the cop does not hit the righting chute 10 as hard.

In the vicinity of the delivery end 15 of the righting chute 10 is located a controllable stop lever 49. It can be rotated around an axis 52 in the direction of the double arrow 51 with the aid of an electromagnet, in particular a rotary magnet 50. A lever 53 is non-rotatably connected with the axis of rotation 55 of the rotary magnet 50. Via a joint 56 the lever 53 is articulated with another lever 54, the two together forming a toggle joint. The lever 54 is adjustable lengthwise. The lever 54 has been made lengthwise-adjustable, so that the pivot of the knee joint consisting of levers 53 and 54, namely, the pivots 55, 56 and 57, can be brought out into an extended position lying along the same line (see FIG. 2). Thus, the support 59 may be positioned in the ideal position for engaging the cop end. In its starting position, in other words, in the rest position of the magnet, the toggle joint is stretched out, i.e. the joint points 55, 56 and 57 lie in a straight line. This results in thorough breaking of the fall. If the magnet rotates, for example, in the direction of the arrow 58, it results in the stop lever 49 turning in the same direction of rotation. Its supporting end 59, which extends into the chute, then releases the front end 44 of the cop lying on it, so that the cop 3 can drop down into the approximately aligned bobbin receptacle 6. The stop lever 49 is made of a shock-absorbing material, in particular out of a plastic with sufficient elasticity, but with strength and low wear.

A controllable ejection lever 60 can be applied to the upper end 61 of the cop 3 supported on the stop lever 49. It is not brought into operating position until the lower end 44 of the cop rests on the supporting end 59 of the stop lever. The ejection lever 60 is pivoted in synchrony with the stop lever 49 in the same rotational direction. It supports and speeds up the process of sliding the cop 3 out of the righting chute 10. The axis of rotation of the ejection lever 60 is designated 62.

In the forward direction of the cop 3 sliding down the righting chute 10, there projects into the field of motion of the cop a braking element 63 preferably in the shape of a plate that can be deflected outwardly. The end 64 of element 63 that extends toward the chute 10 is designed as a centering element for the oncoming cop. It has a cut-out in the shape of an arc, triangle, trapezoid or the like.

A geared motor 65 drives a first toothed belt disc 66, which turns a second toothed belt disc 68 via a toothed belt 67. The second toothed belt disc 68 is seated on the drive shaft 69 for the corresponding halves of the slide gate units 13 and 14. The slide gate unit halves are driven by means of two eccentrics 70 and 71 also non-rotatably seated on the drive shaft 69. They engage in corresponding slots 87 of the slide gate unit halves. By this means the slide gate unit halves can be slid forward and back perpendicular to the projection plane of FIG. 3 without a reversal of rotation direction on the part of the geared motor 65. To guide the halves of the slide gate units 13 and 14 rollers or sliding pieces 72 and 73 are provided for a guide plate 74 for each.

Figure 3:
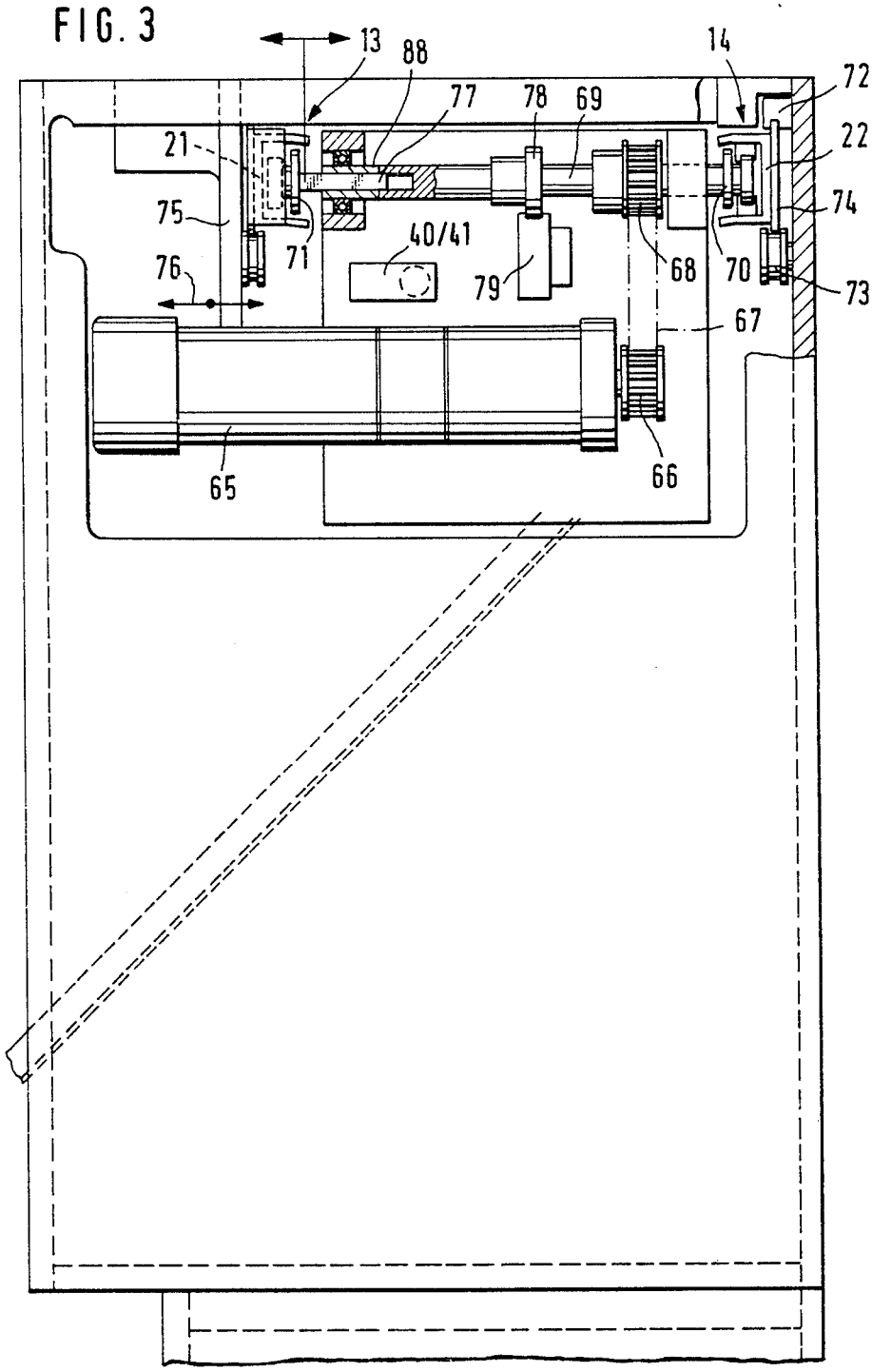
FIG. 3 is a vertical sectional view taken through the slide gate unit.

An internal wall 75 positioned by what in FIG. 3 is the left end of the drive shaft 69, is adjustable and lockable in the direction of the double arrow 76. If starting from the position shown in FIG. 3 it is moved to the left. This has the effect of also moving the two havles of the slide gate unit 13 in the same direction. This increases the distance between the corresponding upper and lower supports and those opposite them, so that longer cops can now be supported. For this purpose, however, it is necessary for the drive shaft 69 to be able to pull out like a telescope. This is accomplished by a many-sided, specifically a four-sided shape 77 on the short left piece in FIG. 3 of the drive shaft 69 that engages positively in a recess 88 in the left end of the long right section of the drive shaft 69. The drive shaft 69 performs a 360° turn or two 180° turns following quickly upon one another. During the first 180° turn the upper guides 29 are opened and the lower guides closed, while during the second 180° turn the slide gate units or the halves thereof are pushed back into their starting position. The full or the two half rotations are accomplished with the aid of a trip cam 78 seated on the drive shaft 69, which works in conjunction with a stationary switch 79. The speed of motion of the slides can be adjusted to the size and weight of the cops by means of corresponding changes in the rpm of the first toothed belt disc 66.

The drive for each conveyor element of the cross-conveyor 11 or 12 is also accomplished by means of a geared motor 80 for each. Its drive shaft bears a toothed belt disc 81, which transmits the torque via a toothed belt 82 to another toothed belt disc 83. If necessary, a clutch 84 can also be interposed between the drive shaft of the motor and the first toothed belt disc 81. The second toothed belt disc 83 is coaxially connected with a front reversing roller 85 or the like for the conveyor element 24. A rear reversing roller or the like is labelled 86.

While specific embodiment of the invention has been shown and described in detail to illustrate the application of the principles of the invention, it will be understood that the invention may be embodied otherwise without departing from such principles.

What is claimed is:

1. A device for transferring bobbins of yarn from a bobbin container to a bobbin receptacle on a spooling frame, comprising: a frame; at least one pair of slide gate units for receiving a row of bobbins, said slide gate units being mounted for sliding movement to said device frame and being spaced from each other by distance substantially equal to an axial length of the bobbins, each slide gate unit having means for carrying one end of one of said bobbins so that each bobbin is supported between said one pair of slide gate units; at least one cross-conveyor mounted for movement to said frame below said at least one pair of slide gate units, said means for carrying the bobbin ends of each slide gate unit being movable with movement of each slide gate unit to discharge a bobbin from said pair of slide gate units to said at least one cross-conveyor, said cross-conveyor having a delivery end for delivering bobbins on said cross-conveyor, a righting chute connected to said frame and positioned below said slide gate units and adjacent said delivery end of said cross-conveyor for receiving bobbins from one end of said slide gate units and from said delivery end of said cross-conveyor, said righting chute having a chute delivery end spaced away from said conveyor delivery end and away from said slide gate units from which bobbins are discharged from said chute, closing means operatively connected to said chute for closing said chute delivery end to retain a bobbin on said chute, whereby with said chute delivery end being adjacent a bobbin receptacle of a spooling frame, said closing means are activatable to release a bobbin from said righting chute to drop into the bobbin receptacle, said righting chute extending in a direction substantially parallel to an axis of the bobbin receptacle so that bobbins moving from said righting chute are discharged into the bobbin receptacle.

2. A device according to claim 1 including a second cross-conveyor mounted for movement to said frame at the same level as said at least one cross-conveyor, said second cross-conveyor having a discharge end which is opposite from said conveyor discharge end said at least one cross-conveyor, and conveyor drive means connected to said at least one cross-conveyor and said second cross-conveyors for driving said cross-conveyors in opposite directions toward their respective conveyor delivery ends.

3. A device according to claim 2 wherein said at least one and said second cross-conveyors each include an endless conveyor element having a horizontal conveying surface movable by said conveyor drive means.

4. A device according to claim 3 wherein said conveyor element of each cross-conveyor includes a plurality of projecting ridges spaced there along dividing said horizontal conveying surface into equal segments each for receiving one bobbin, each segment having a width in the direction of movement of said horizontal conveying surface which is approximately equal to a diameter of a bobbin to be conveyed, said conveyor drive means including means for intermittently moving said horizontal conveying surfaces by incremental lengths equal to the width of said equal segments.

5. A device according to claim 3 wherein said righting chute is inclined with respect to said horizontal conveying surface, said chute discharge end being lower than a chute receiving end which is adjacent said conveyor discharge end of said at least one cross-conveyor.

6. A device according to claim 1 including a damping lever pivotally mounted to said frame, said at least one cross-conveyor having a conveying element with a horizontal conveying surface position below said pair of slide gate units, said damping lever being pivotally mounted about a horizontal axis and having one end adjacent said conveyor delivery end and extending into a path of movement of one end of a bobbin falling from said at least one cross-conveyor onto said chute for slowing the descent of the one end of the bobbin as it falls onto said chute, said one end of said damping lever pivotal away from said path of movement as the bobbin passes the damping lever.

7. A device according to claim 6 wherein said damping lever comprises a two armed lever having one arm carrying said one end of said lever which projects into the path of movement of a bobbin, and an opposite end, said one end of said two armed lever comprising an impact member against which the one end of the bobbin falls and an adjustable weight operatively connected to said opposite end of said damping lever for counterbalancing said impact member.

8. A device according to claim 1 wherein, said closing means of said righting chute are adjustable in position along the length of the righting chute and said righting chute is adjustable with respect to the bobbin receptacle.

9. A device according to claim 1 wherein said closing means comprises a stopping lever pivotally mounted to said frame and having a stopping end movable into a path of movement of a bobbin on said chute adjacent said chute delivery end for stopping a bobbin on said chute at said chute delivery end.

10. A device according to claim 9 wherein said closing means includes an electromagnet operatively connected to said stop lever for pivoting said stop lever to move said stopping end out of the path of movement of a bobbin on said chute.

11. A device according to claim 10 wherein said electormagnet comprises a rotary magnet having an axis of rotation, a toggle joint connected between said axis of rotation and said stop lever for rotating said stop lever with activation of said rotary magnet, said stop lever being mounted to said device frame at a rotation axis, said toggle joint being connected to said stop lever at an articulation point which is spaced away from said rotation axis of said stop lever.

12. A device according to claim 11 wherein said toggle joint comprises a first lever portion connected to said rotary magnet for rotation about said axis of rotation of said rotary magnet and a second lever portion connected to said first lever portion at a pivot point, said pivot point, said axis of rotation of said rotary magnet and said articulation point extending in a straight line when said stopping end of said stop lever is in the path of movement of a bobbin on said chute for stopping the bobbin on said chute.

13. A device according to claim 12 wherein said stop lever is made of shock absorbing material.

14. A device according to claim 9 wherein said chute is inclined, a bobbin on said chute having a lower end engageable with said stopping end of said stop lever and an upper end, an ejection lever pivotally mounted to said frame and having an ejection end movable into the path of movement of the upper of the bobbin on said chute, and means for pivoting said ejection lever in synchronism with pivoting of said stop lever for moving said ejection end against an upper end of a bobbin while said stopping end of said stop lever is moved out of the path of movement of the bobbin for ejecting a bobbin from said chute.

15. A device according to claim 14 including a plate-shaped braking element positioned upstream of said stop lever in the direction of movement of a bobbin on said chute for braking movement of a bobbin as it leaves said chute.

16. A device according to claim 15 wherein said braking element has a lower end for engaging a bobbin to center a bobbin on said chute as the bobbin moves on said chute.

17. A device according to claim 1 wherein each of said slide gate units has a U-shaped cross section taken in a vertical plane, said cross conveyor having a conveyor element with a horizontal conveying surface, said slide gate units being mounted for movement in a horizontal direction on said frame, each U-shaped cross section of said slide gate units having an upper leg and a lower leg extending substantially parallel to said horizontal conveying surface, said upper and lower legs each having a plurality of alternating tabs and recesses, each recess being slightly larger than an end of a bobbin to be supported on said slide gate units, said tabs and recesses of said upper legs being staggered with respect to said tabs and recesses of said lower legs so that bobbins discharged onto said slide gate units have their ends initially supported between the tabs of said upper legs, said slide gate units being moved to discharge the bobbins so that their ends fall through recesses of said upper legs onto tabs of said lower legs and, thereafter, said slide gate units are movable to discharge the ends of the bobbins through the recesses of the lower legs onto said cross-conveyor.

18. A device according to claim 17 including means defining vertical guides fixed to said device frame and positioned for guiding ends of said bobbins through said recesses of said upper and lower legs and past said tabs of said upper and lower legs.

19. A device according to claim 18 wherein each of said guides is formed by a pair of spaced apart blocks having selected widths which are selected to provide vertical guides sufficiently large to pass the ends of the bobbins.

20. A device according to claim 19 wherein one of said vertical guides at an end of said slide gate units is positioned above said chute, the remainder of said guides being positioned above said cross-conveyor.

21. A device according to claim 1 wherein said slide gate units and said cross-conveyor extend horizontally, said cross-conveyor being spaced vertically below said slide gate units to define an intermediate space there between, and first sensing means connected to said frame for sensing said intermediate space for the presence of bobbins therein which had dropped from said slide gate units onto said cross-conveyor.

22. A device according to claim 21 including second sensor means connected to said frame for sensing the presence of a bobbin on said chute near said chute delivery end.

23. A device according to claim 22 wherein each slide gate unit comprises a slide slidably mounted to said frame, slide drive means operatively connected to said slides for moving said slides horizontally to discharge bobbins received on said slides onto said cross-conveyor, said slide drive means being connected to said two slides for moving said two slides in synchronism with each other.

24. A device according to claim 23 wherein said slide drive means are operatively connected to said first and second sensing means for activation and response to signals from said first and second sensing means.

25. A device according to claim 24 wherein said slide drive means comprises an electric motor, an eccentric connected to said electric motor for rotation by said electric motor, said eccentric being operatively connected to said slides for moving said slides horizontally with rotation of said eccentric.

26. A device according to claim 25 including adjusting means connected to at least one of said slides for moving said one slide toward and away from the other slide for adjusting the distance between said slides for accommodating bobbins of different lengths.

27. A device according to claim 26 wherein said slide drive means include a drive shaft connected betewen said electric motor and said eccentric for rotating said eccentric, said drive shaft being telescopic for accommodating the adjustments of said adjusting means.

28. A device according to claim 27 where said electric motor comprises a geared motor, said slide drive means including a toothed disc connected to said geared motor for rotation by said geared motor, a toothed disc connected to said drive shaft and a toothed belt engaged between said toothed discs for transmitting rotation of said geared motor to rotation of said drive shaft.

29. A device according to claim 28 including a trip cam connected to said drive shaft and a motor switch engageable by said trip cam for causing a selected amount of rotation of said drive shaft with activation of said motor for moving said slide gate units only by a selected amount.

30. A device according to claim 29 including conveyor drive means connected to said conveyor for moving said conveyor only by discreet amounts.

31. A device according to claim 30 wherein said conveyor drive means comprises a geared motor, a clutch connected to said geared motor, a toothed disc connected to said clutch, a toothed disc operatively connected to said conveyor and a toothed belt connected between said toothed disc of said conveyor drive means for moving said conveyor.

32. A device according to claim 31 wherein said first and second sensor means comprise first and second optical sensors.

* * * * *